US007735925B2

(12) United States Patent
Lin

(10) Patent No.: US 7,735,925 B2
(45) Date of Patent: Jun. 15, 2010

(54) POSITIONING DEVICE FOR CHAIR

(75) Inventor: Chang-Chen Lin, Guanmiao Township, Tainan County (TW)

(73) Assignee: Zhongshan Kemi Commodity Co., Ltd., Guangdong Province (CN)

( * ) Notice: Subject to any disclaimer, the term of this patent is extended or adjusted under 35 U.S.C. 154(b) by 0 days.

(21) Appl. No.: 12/552,843

(22) Filed: Sep. 2, 2009

(65) Prior Publication Data

US 2010/0117423 A1 May 13, 2010

Related U.S. Application Data

(63) Continuation-in-part of application No. 12/270,280, filed on Nov. 13, 2008.

(51) Int. Cl.
*A47C 1/027* (2006.01)

(52) U.S. Cl. ..... 297/317; 297/320; 297/322

(58) Field of Classification Search ..... 297/313, 297/317, 320, 322; 188/67
See application file for complete search history.

(56) References Cited

U.S. PATENT DOCUMENTS 2,617,471 A * 11/1952 Lorenz ..... 297/321
3,934,932 A * 1/1976 Ekornes ..... 297/320
3,947,069 A * 3/1976 Lusch ..... 297/317
4,614,377 A * 9/1986 Luo ..... 297/19
4,660,884 A * 4/1987 Terui et al. ..... 297/317
5,211,444 A * 5/1993 Kjellman ..... 297/375
5,624,159 A * 4/1997 Celoni et al. ..... 297/325

* cited by examiner

*Primary Examiner*—Peter R. Brown
(74) *Attorney, Agent, or Firm*—Banger Shia

(57) ABSTRACT

A positioning device includes a clamping seat having first and second clamping members with clamping portions mounted around a fixed rod of a chair having an inclinable seat to which the first clamping member is fixed. An adjusting rod includes a coupling seat having a positioning groove with a low-profile section and a high-profile section. A positioning block is mounted to the second clamping member and includes a protrusion received in the positioning groove. The protrusion is engagable with one of the low-profile section and the high-profile section, so that the clamping portions can be clamp on or disengage from the fixed rod, allowing controlling of movement of the clamping seat along the fixed rod. The first clamping member includes a sidewall having a hole slideably receiving the fixed rod and in slight tight coupling with the fixed rod.

8 Claims, 10 Drawing Sheets

A-A

POSITIONING DEVICE FOR CHAIR

CROSS REFERENCE TO RELATED APPLICATION

This is a continuation-in-part application of U.S. patent application Ser. No. 12/270,280 filed Nov. 13, 2008.

BACKGROUND OF THE INVENTION

The present invention relates to a positioning device for a chair and, more particularly, to a stable, easy-to-adjust positioning device for a leisure chair with an inclinable seat.

A typical leisure chair includes a base, a rod fixed on the base, and an inclinable seat mounted on the base and pivotable to an inclined angle relative to the rod. A positioning device in the form of a knob is releasably mounted to the rod and fixed to the seat to move therewith. When it is desired to move the seat to an inclination angle, the knob is firstly disengaged from the rod to allow the seat to be pivoted to a desired inclined angle. Then, the knob is reengaged with the rod to fix the seat in the inclined angle. However, operation of the knob is inconvenient, and the knob can not provide a reliable positioning effect. Furthermore, the backrest is liable to incline rearward due to gravity during adjustment, which is not always desirable.

Thus, a need exists for a positioning device for a chair with an inclinable seat that can be easily operated while providing a reliable positioning effect.

BRIEF SUMMARY OF THE INVENTION

The present invention solves this need and other problems in the field of positioning of a chair seat by providing, in a preferred form, a positioning device including a positioning device for a chair including a clamping seat having first and second clamping members pivotably connected together. Each of the first and second clamping members includes first and second side spaced in a longitudinal direction. The second side of the first clamping member includes a first clamping portion, and the first side of the second clamping member includes a second clamping portion facing the first clamping portion. The first and second clamping portions of the first and second clamping members are adapted to be mounted around a fixed rod of a chair. The first clamping member further includes a first through-hole extending from the first side through the second side of the first clamping member. The second clamping member further includes a second through-hole extending from the first side through the second side of the second clamping member. A spring is mounted between the first and second clamping members to bias the first and second clamping portions to an open state not clamped on the fixed rod, allowing movement of the clamping seat along the fixed rod. The first side of the first clamping member further includes a first sidewall spaced from the first clamping portion in a width direction perpendicular to the longitudinal direction. The first sidewall includes a first hole slideably receiving the fixed rod. The first side of the first clamping member further includes a coupling portion adapted to be fixed to an inclinable seat of the chair that is movable relative to the fixed rod. A positioning block is mounted to the second clamping member and includes first and second sides spaced in the longitudinal direction. The positioning block further includes a third through-hole extending from the first side of the positioning block through the second side of the positioning block and aligned with the second through-hole of the second clamping member. The second side of the positioning block includes a protrusion. An adjusting rod includes a coupling seat and a handle fixed to the coupling seat to move therewith. The coupling seat includes first and second sides spaced in the longitudinal direction and a fourth through-hole extending from the first side of the coupling seat through the second side of the coupling seat. The first side of the coupling seat includes a positioning groove having a low-profile section, a high-profile section, and a transition section between the low-profile section and the high-profile section. The handle is pivotable between a release position and a clamping position. A coupling rod is extended through the first, second, third, and fourth through-holes. The protrusion of the positioning block is received in the positioning groove of the coupling seat and engaged with one of the low-profile section and the high-profile section.

When the handle is in the release position, the protrusion of the positioning block is engaged with the low-profile section, and the first and second clamping members are in an open state under the action of the spring, so that the first and second clamping portions of the first and second clamping members are not clamped on the fixed rod, allowing movement of the clamping seat along the fixed rod and allowing movement of the inclinable seat relative to the fixed rod.

On the other hand, when the handle is in the clamping position, the protrusion of the positioning block is engaged with the high-profile section, and the first and second clamping members are in a clamping state, so that the first and second clamping portions of the first and second clamping members are clamped on the fixed rod, not allowing movement of the clamping seat along the fixed rod and not allowing movement of the inclinable seat relative to the fixed rod.

In the most preferred form, the first side of the first clamping member further includes a second sidewall. The first and second sidewalls define a compartment receiving the second clamping member. The first clamping portion of the first clamping member is intermediate the first and second sidewalls in the width direction. The second sidewall includes a second hole slideably receiving the fixed rod.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
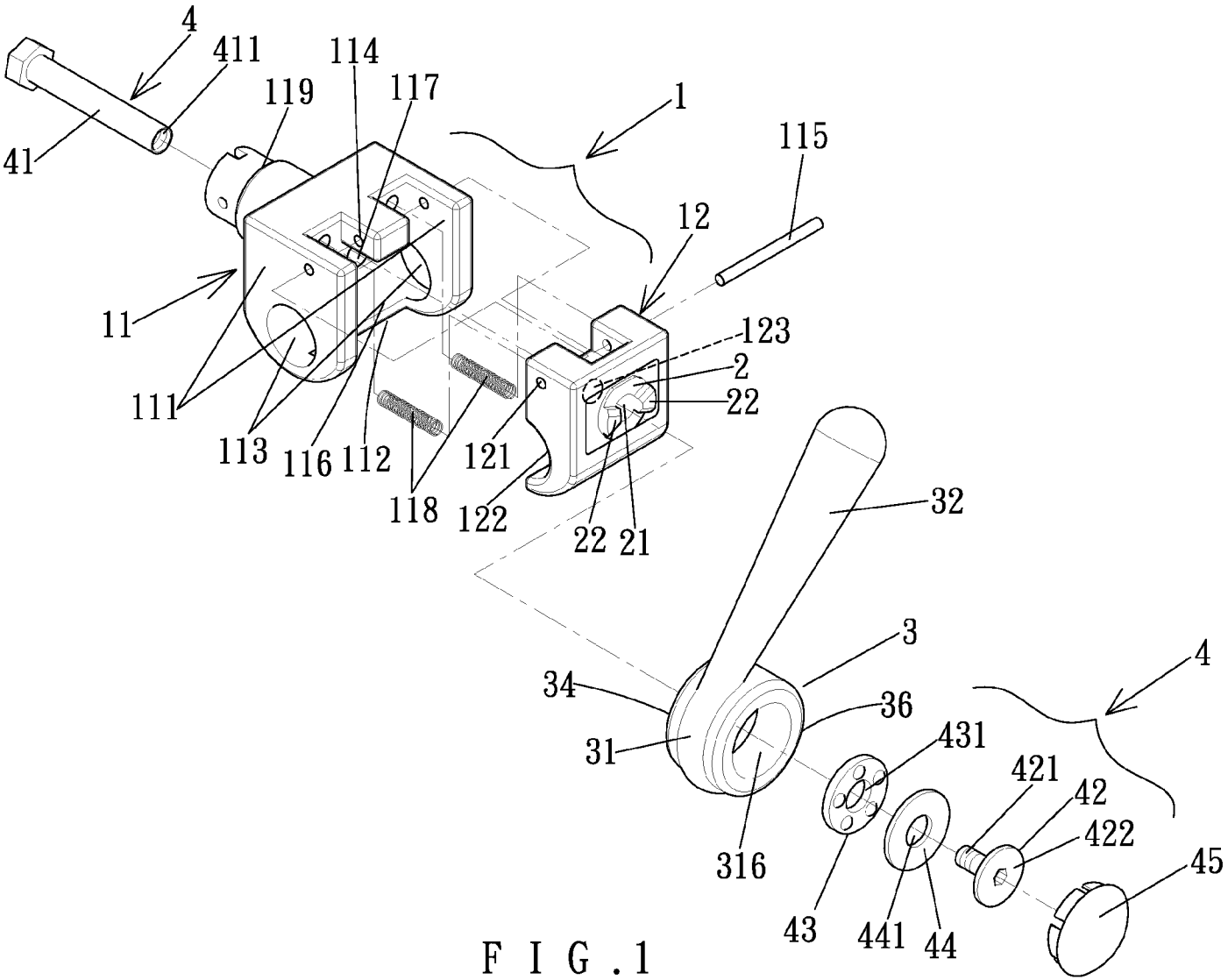
FIG. 1 shows an exploded, perspective view of a positioning device for a chair according to the preferred teachings of the present invention.
Figure 2:
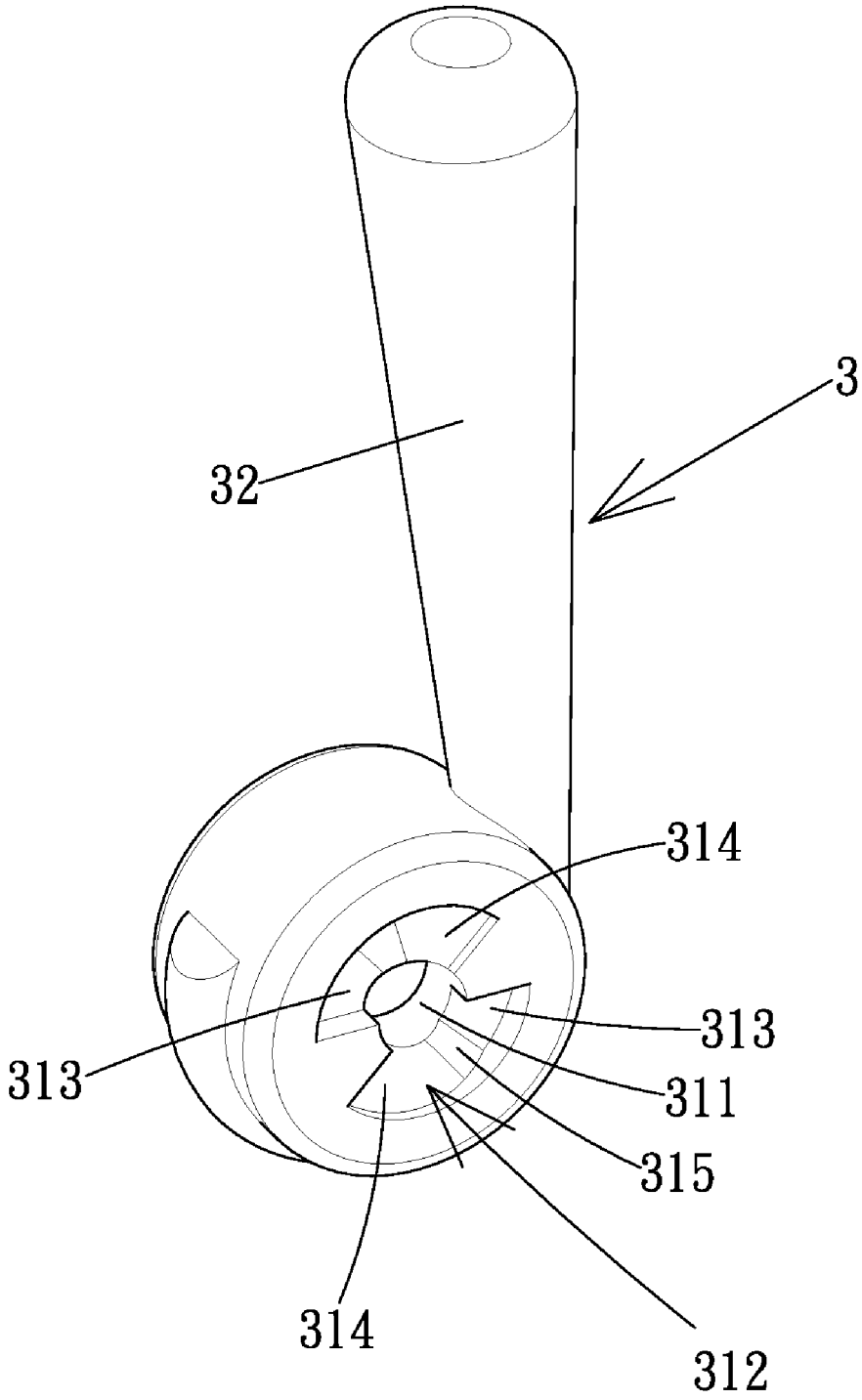
FIG. 2 shows a perspective view of an adjusting rod of the positioning device of FIG. 1.
Figure 3:
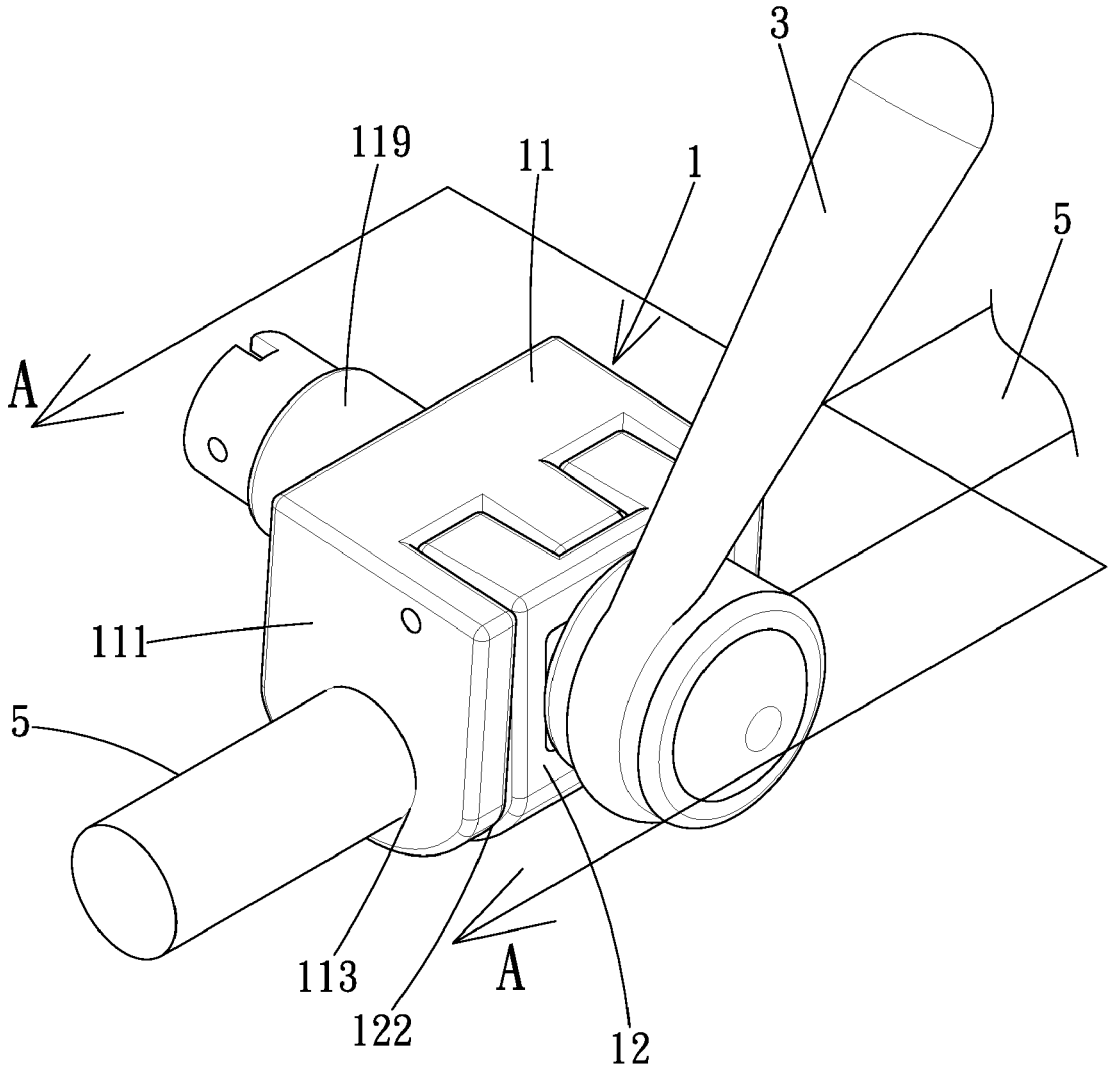
FIG. 3 shows a perspective view of the positioning device of FIG. 1.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

A positioning device according to the preferred teachings of the present invention is shown in the drawings and generally includes a clamping seat 1, a positioning block 2, an adjusting rod 3, and a coupling mechanism 4.

Figure 4:
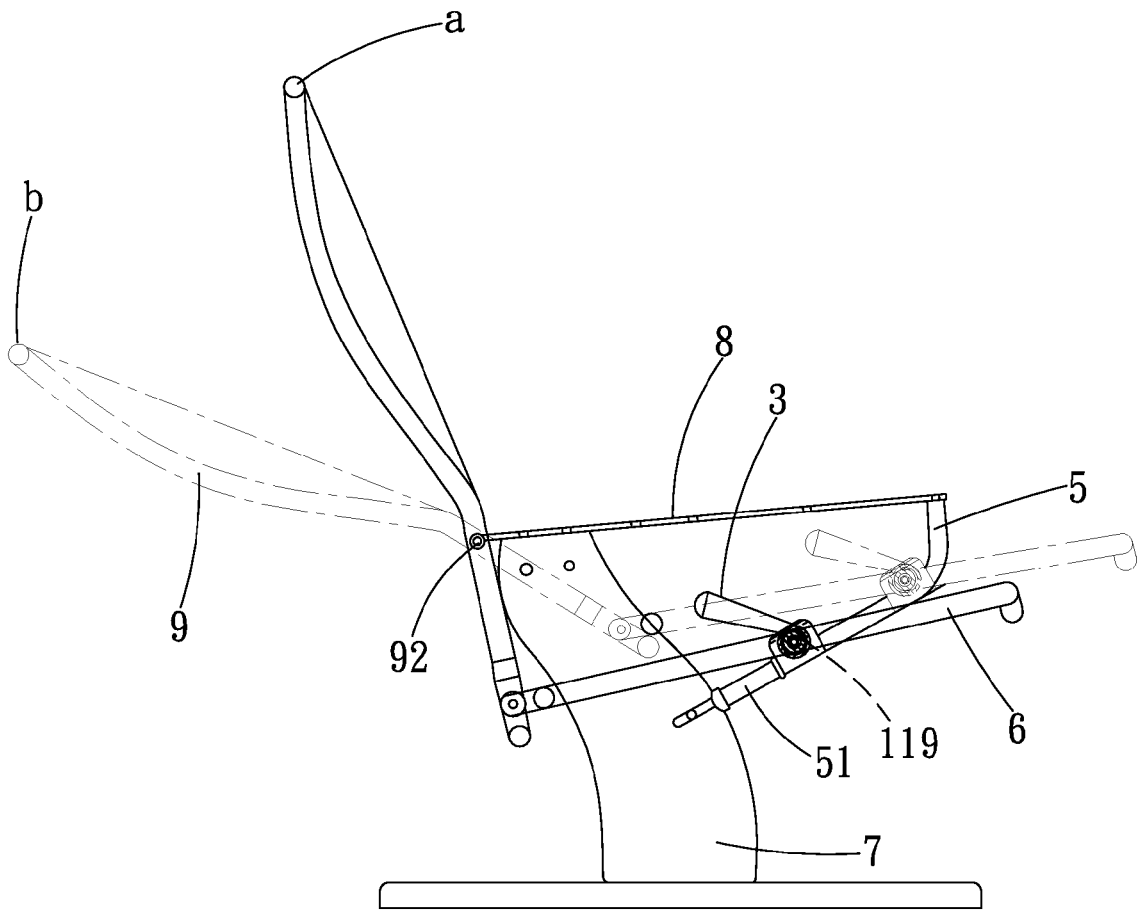
FIG. 4 shows a partly cross sectioned view of a chair including an inclinable seat, a fixed rod, and the positioning device of FIG. 1.
Figure 5:
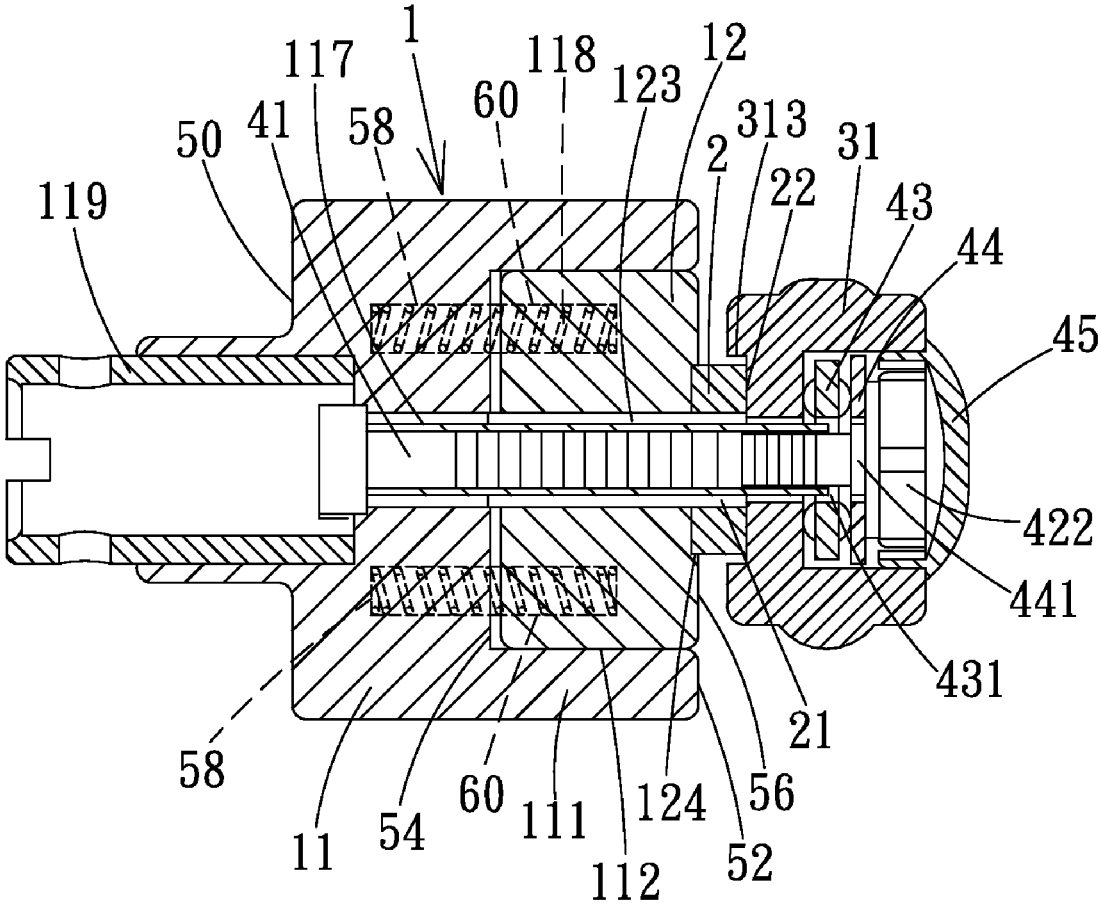
FIG. 5 shows a cross sectional view of the positioning device of FIG. 3 according to section line A-A of FIG. 3 with two clamping members of the positioning device in an open state.
Figure 6:
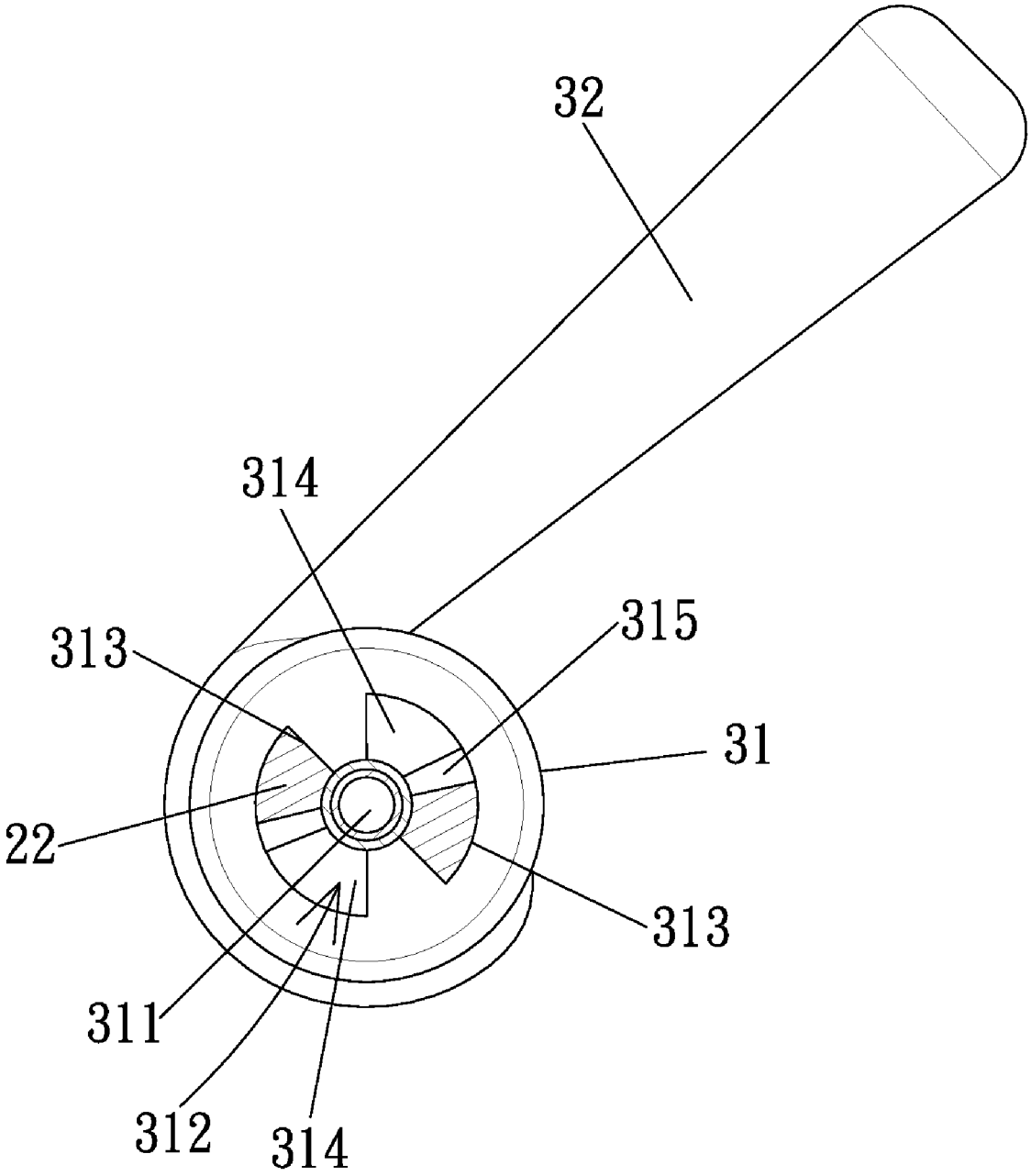
FIG. 6 shows another cross sectional view of the positioning device of FIG. 3 with the clamping members of the positioning device in an open state.
Figure 7:
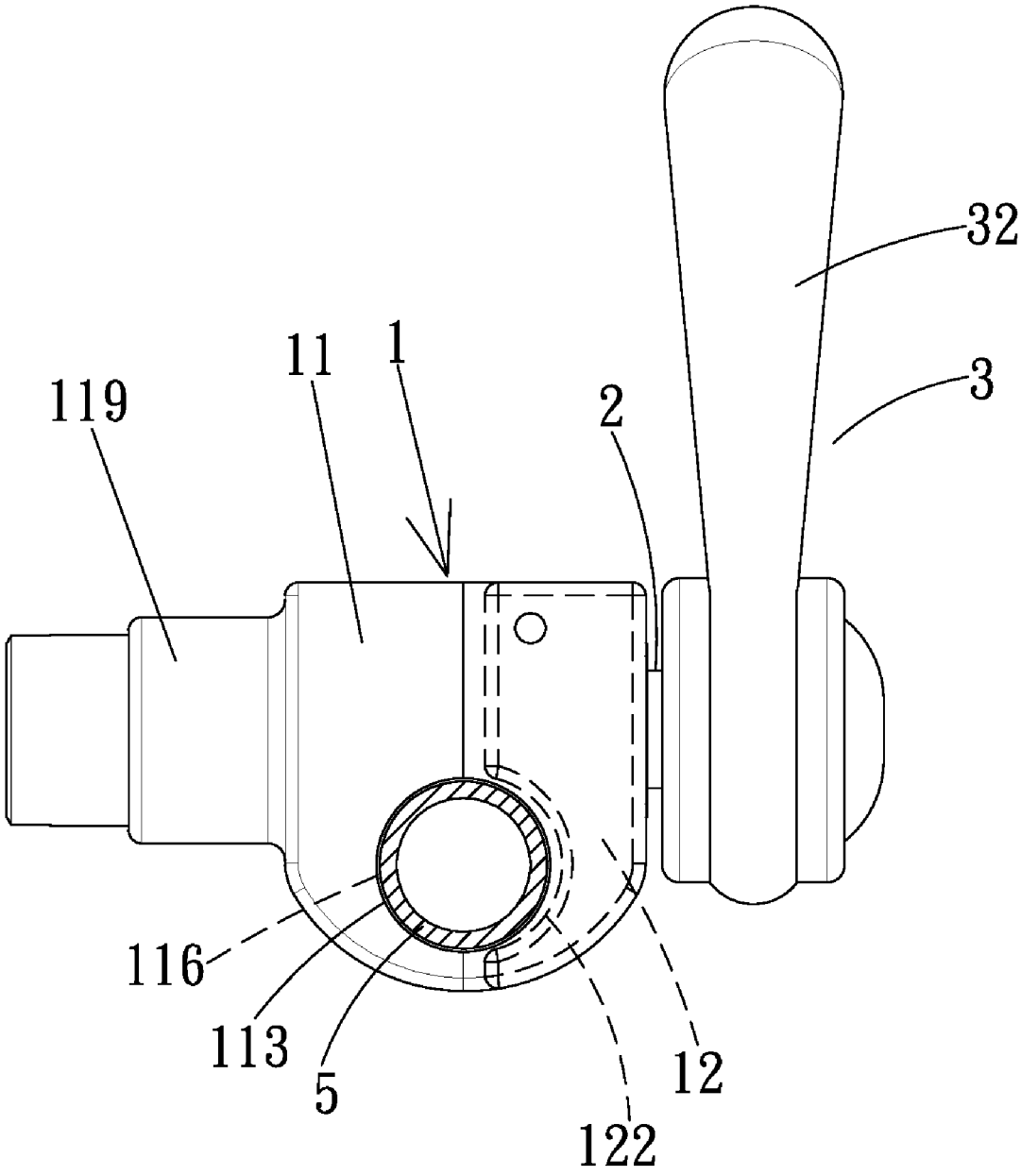
FIG. 7 shows another cross sectional view of the positioning device of FIG. 3 with the clamping members of the positioning device in the open state.
Figure 8:
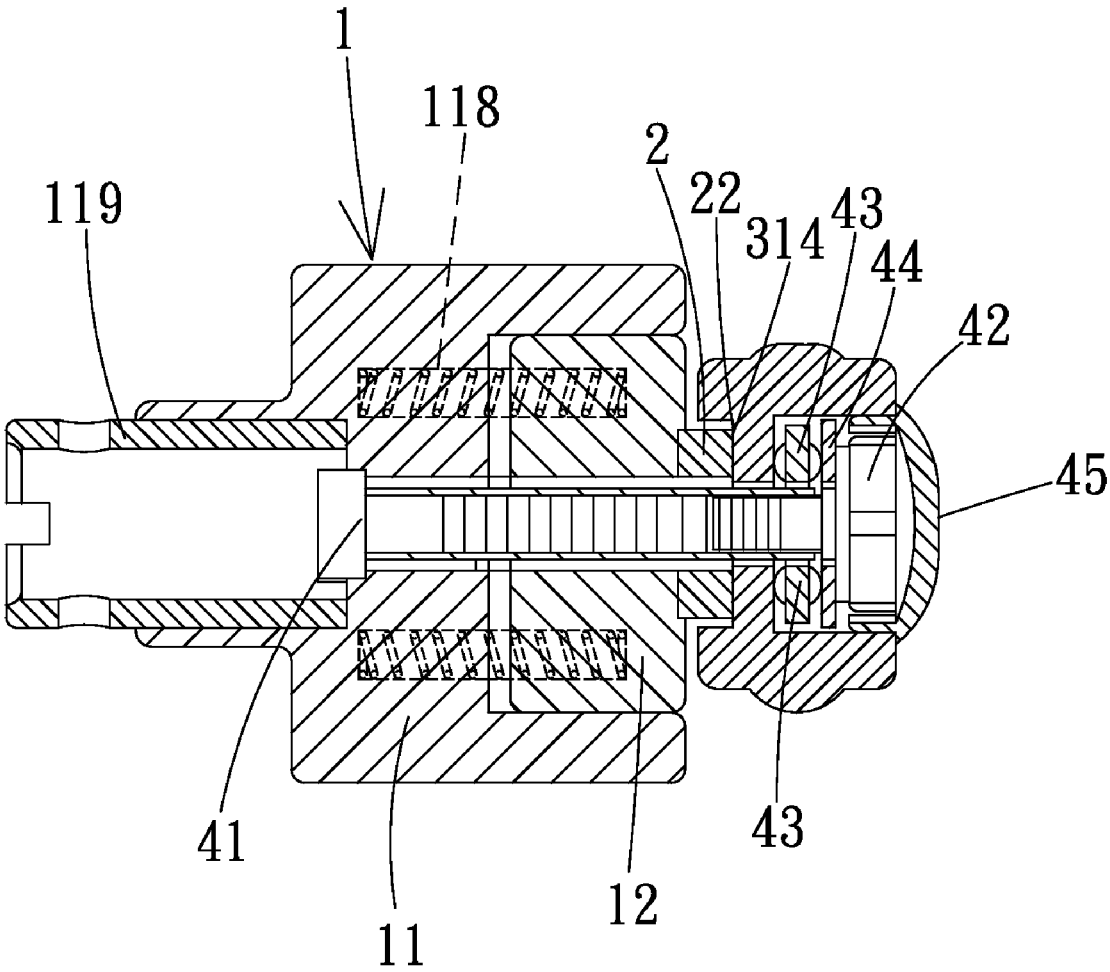
FIG. 8 is a cross sectional view similar to FIG. 5, with the clamping members in a clamping state.
Figure 9:
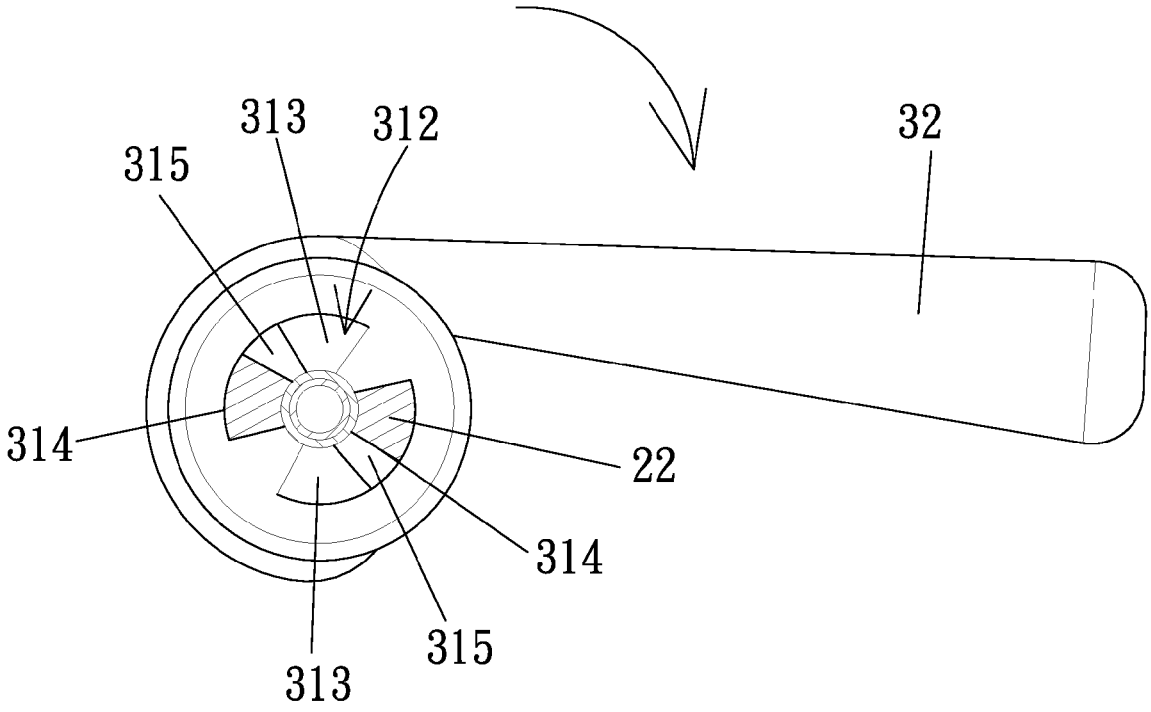
FIG. 9 is a cross sectional view similar to FIG. 6, with the adjusting rod of the positioning device moved to a position so that the clamping members are moved to the clamping state.
Figure 10:
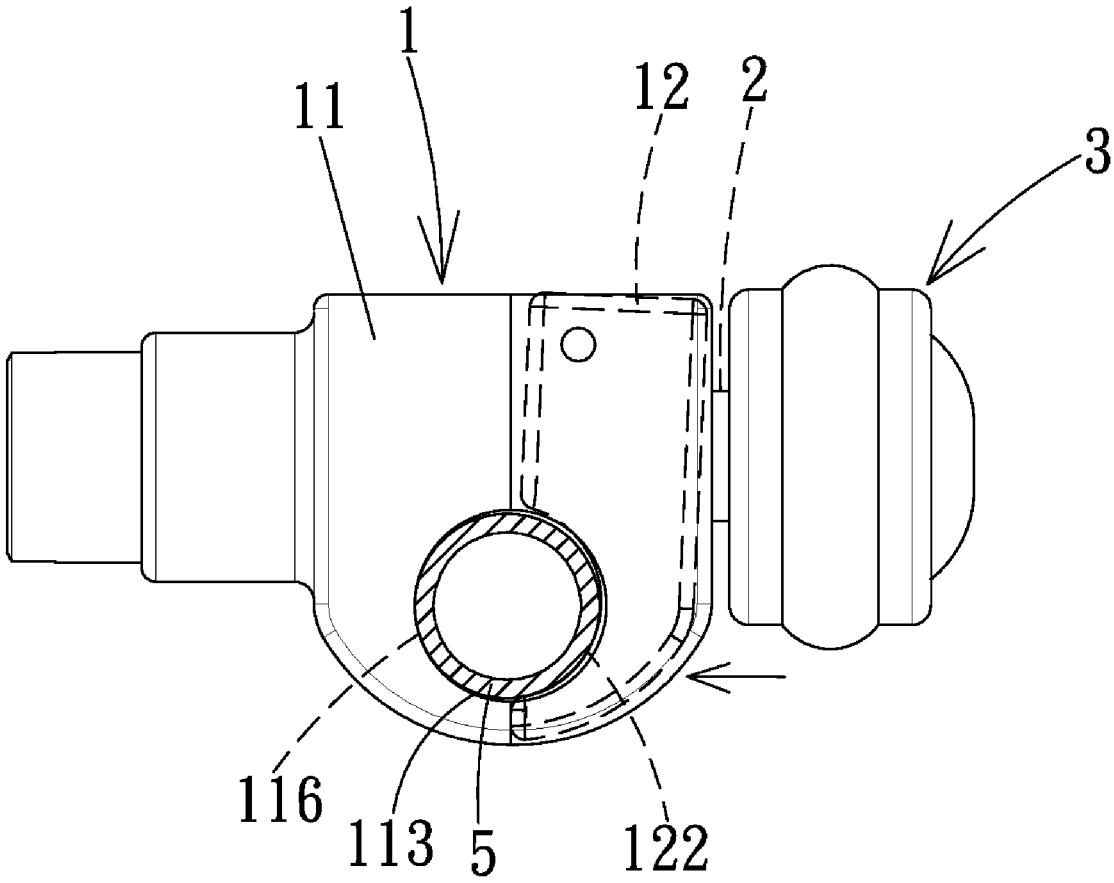
FIG. 10 is a cross sectional view similar to FIG. 7, with the clamping members in the clamping state.

According to the preferred form shown, the clamping seat 1 includes first and second clamping members 11 and 12 each having first and second sides 50 and 52, 54 and 56 spaced in a longitudinal direction. The second side 52 of the first clamping member has a pivotal portion 114. The first side 54 of the second clamping member 12 has a pivotal portion 112 facing the pivotal portion 114. The first side 50 of the first clamping member 11 further includes first and second sidewalls 111 on opposite sides of the pivotal portion 114 and spaced in a width direction perpendicular to the longitudinal direction. The first and second sidewalls 111 define a compartment 112 for receiving the second clamping member 12. Each of the first and second sidewalls 111 has a hole 113 for receiving a fixed rod 5 of a chair such as a leisure chair having an inclinable seat 6 (FIG. 4). The hole 113 of each of the first and sidewalls 111 has a diameter is slightly larger than an outer diameter of the fixed rod 5, allowing sliding of the clamping seat 1 along the fixed rod 5. Furthermore, an inner periphery of the hole 113 of each of the first and sidewalls 111 is in slight tight coupling with an outer periphery of the fixed rod 5. A pin 115 is extended through the pivotal portions 111 and 121 to allow relative pivotal movement between the first and second clamping members 11 and 12. Each of the second side 52 of the first clamping member 11 and the first side 54 of the second clamping member 12 further includes a clamping portion 116, 122 for clamping on the fixed rod 5.

Each of the first and second clamping members 11 and 12 further includes a through-hole 117, 123 extending from the first side 50, 54 through the second side 52, 56. The through-hole 117 is intermediate and spaced from the pivotal portion 114 and the clamping portion 116 in a height direction perpendicular to the longitudinal direction and the width direction. The through-hole 123 is intermediate and spaced from the pivotal portion 121 and the clamping portion 122 in the height direction and includes an enlarged section 124 in the second side 56 of the second clamping member 12. Furthermore, two springs 118 are mounted between the first and second clamping members 11 and 12 to bias the clamping portions 116 and 122 away from each other to an open state, so that the fixed rod 5 is not clamped by the clamping portions 116 and 122. In the most preferred form shown, the through-hole 117 of the first clamping member 11 extends from the first side 50 through a bottom wall of the compartment 112. Furthermore, the bottom wall of the compartment 112 of the first clamping member 11 includes two first receptacles 58, and the first side 54 of the second clamping member 12 includes two second receptacles 60 aligned with the first receptacles 58. Each of two ends of each spring 118 is received in one of the first and second receptacles 58 and 60. Further, the first side 50 of the first clamping member 11 includes a coupling portion 119 fixed to a side of the inclinable seat 6.

According to the preferred form shown, the positioning block 2 includes a first side received in the enlarged section 124 of the through-hole 123 of the second clamping member 12. The positioning block 2 further includes a second side outside of the enlarged section 124 and spaced from the first side of the positioning block 2 in the longitudinal direction. Furthermore, the positioning block 2 includes a through-hole 21 extending from the first side thereof and through the second side thereof and aligned with the through-hole 123 of the second clamping member 12. Two protrusions 22 are formed on the second side of the positioning block 2 and surround the through-hole 21 of the positioning block 2.

According to the preferred form shown, the adjusting rod 3 includes a coupling seat 31 and a handle 32 fixed to an outer periphery of the coupling seat 1. The coupling seat 31 includes first and second sides 34 and 36 spaced in the longitudinal direction. The coupling seat 31 further includes a through-hole 311 extending from the first side 34 through the second side 36. In the most preferred form shown, the first side 34 of the coupling seat 31 includes two annularly spaced positioning grooves 312 each having a low-profile section 313, a high-profile section 314, and an inclined transition section 315 between the low-profile section 313 and the high-profile section 314. Furthermore, a compartment 316 is formed in the second side 36 of the coupling seat 31 and in communication with the through-hole 311 of the coupling seat 31.

According to the preferred form shown, the coupling mechanism 4 includes first and second coupling rods 41 and 42, a bearing 43, a washer 44, and an end cap 45. The first coupling rod 41 is extended through the through-holes 117, 123, 21 and 311 respectively of the first clamping member 11, the second clamping member 12, the positioning block 2, and the coupling seat 31. The first coupling rod 4 includes an end having a screw hole 411. The bearing 43 is received in the compartment 316 and in contact with a bottom wall of the compartment 316. The bearing 43 includes a central hole 431 through which the first coupling rod 41 extends. The washer 44 is received in the compartment 316 and includes a central hole 441 through which the first coupling rod 41 extends. The second coupling rod 42 is received in the compartment 316 and includes a threaded portion 421 on an end thereof threadedly engaged with the screw hole 411. The second coupling rod 42 further includes an enlarged head 422 on the other end thereof. The enlarged head 422 presses against the washer 44, which in turn, presses against the coupling seat 31 and the positioning block 32, so that the protrusions 22 of the positioning block 2 are received in the positioning grooves 312 of the coupling seat 31. The end cap 45 is fixed to the second side 36 of the coupling seat 31 to cover the compartment 316.

With reference to FIGS. 4-7, an end of the fixed rod 5 is attached to a base 7 of the chair, and an armrest 8 having a front end mounted on top of the fixed rod 5. The coupling portion 119 is fixed to the inclinable seat 6 that is pivotally connected to a lower end of a backrest 9. The backrest 9 includes an intermediate portion 92 pivotally connected to a rear end of the armrest 8. The fixed rod 5 includes a restraining member 51. Movement of the clamping seat 1 along the fixed rod 5 allows adjustment of the inclination angles of the inclinable seat 6 and the backrest 9. The restraining member 51 restrains a minimum inclination position a of the backrest 9.

The fixed rod 5 is received between the clamping portions 116 and 122 of the first and second clamping members 11 and 12. When the first and second clamping members 11 and 12 is in the open state under the action of the springs 118, the clamping portions 116 and 122 do not clamp on the fixed rod 5, so that the clamping seat 1 can move along the fixed rod 5 to adjust the inclination angle of the inclinable seat 6. The holes 113 of the clamping seat 1 receive the fixed rod 5, guiding movement of the clamping seat 1 along the fixed rod 5. Furthermore, the inner peripheries of the holes 113 of the clamping seat 1 are in slight tight coupling with the outer peripheries of the fixed rod 5, so that the clamping seat 1 will not move due to the gravity of the backrest 9. Instead, the user must apply force to move the clamping seat 1 for adjusting the inclination angle. Inadvertent movement of the backrest 9 to the maximum angular position b (FIG. 4) in the open state of the first and second clamping members 11 and 12 is, thus, avoided. Accordingly, the operation is convenient and stable. In the open state, the handle 32 is in a release position, and each protrusion 22 of the positioning block 2 is engaged with the low-profile section 313 of one of the positioning grooves 312.

With reference to FIGS. 4 and 8-10, when the inclinable seat 6 reaches the desired inclination angle, the handle 32 is pivoted to a clamping position, and each protrusion 22 of the positioning block 2 is moved from the low-profile section 313 through the transition section 315 to the high-profile section 314. The second clamping member 12 is moved away from the adjusting rod 31 and, thus, pivots toward the first clamping member 11. Thus, the first and second clamping members 11 and 12 are moved to a clamping state securely clamped on the fixed rod 5. Movement of the clamping seat 1 along the fixed rod 5 is, thus, prohibited. Accordingly, the inclinable seat 6 is fixed in the inclination angle relative to the fixed rod 5 under convenient and stable operation.

The bearing 43 includes balls that can roll on the bottom wall of the compartment 316 of the coupling seat 31 during pivotal movement of the handle 32, reducing friction and allowing smooth operation. The positioning block 2 can include only one protrusion 22, and the coupling seat 31 can include only one positioning groove 312. The clamping seat 1 can include only one spring 115 between the first and second clamping members 11 and 12. Furthermore, the first clamping member 11 can include only one of the first and second sidewall 111.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A positioning device for a chair comprising, in combination:

a clamping seat including first and second clamping members pivotably connected together, with each of the first and second clamping members including first and second side spaced in a longitudinal direction, with the second side of the first clamping member including a first clamping portion, with the first side of the second clamping member including a second clamping portion facing the first clamping portion, with the first and second clamping portions of the first and second clamping members being adapted to be mounted around a fixed rod of a chair, with the first clamping member further including a first through-hole extending from the first side through the second side of the first clamping member, with the second clamping member further including a second through-hole extending from the first side through the second side of the second clamping member, with a spring mounted between the first and second clamping members to bias the first and second clamping portions to an open state not clamped on the fixed rod, allowing movement of the clamping seat along the fixed rod, with the first side of the first clamping member further including a first sidewall spaced from the first clamping portion in a width direction perpendicular to the longitudinal direction, with the first sidewall including a first hole slideably receiving the fixed rod, with the first side of the first clamping member further including a coupling portion adapted to be fixed to an inclinable seat of the chair that is movable relative to the fixed rod;

a positioning block mounted to the second clamping member and including first and second sides spaced in the longitudinal direction, with the positioning block further including a third through-hole extending from the first side of the positioning block through the second side of the positioning block and aligned with the second through-hole of the second clamping member, with the second side of the positioning block including a protrusion;

an adjusting rod including a coupling seat and a handle fixed to the coupling seat to move therewith, with the coupling seat including first and second sides spaced in the longitudinal direction and a fourth through-hole extending from the first side of the coupling seat through the second side of the coupling seat, with the first side of the coupling seat including a positioning groove having a low-profile section, a high-profile section, and a transition section between the low-profile section and the high-profile section, with the handle pivotable between a release position and a clamping position; and a first coupling rod extending through the first, second, third, and fourth through-holes, with the protrusion of the positioning block received in the positioning groove of the coupling seat and engaged with one of the low-profile section and the high-profile section, wherein when the handle is in the release position, the protrusion of the positioning block is engaged with the low-profile section, and the first and second clamping members are in an open state under the action of the spring, so that the first and second clamping portions of the first and second clamping members are not clamped on the fixed rod, allowing movement of the clamping seat along the fixed rod and allowing movement of the inclinable seat relative to the fixed rod, and wherein when the handle is in the clamping position, the protrusion of the positioning block is engaged with the high-profile section, and the first and second clamping members are in a clamping state, so that the first and second clamping portions of the first and second clamping members are clamped on the fixed rod, not allowing movement of the clamping seat along the fixed rod and not allowing movement of the inclinable seat relative to the fixed rod.

2. The positioning device as claimed in claim 1, with the first hole of the first sidewall having a diameter slightly larger than an outer diameter of the fixed rod, and with the first hole of the first sidewall having an inner periphery in slight tight coupling with an outer periphery of the fixed rod.

3. The positioning device as claimed in claim 1, with the first side of the first clamping member further including a second sidewall, with the first and second sidewalls defining a compartment receiving the second clamping member, with the first clamping portion of the first clamping member intermediate the first and second sidewalls in the width direction, and with the second sidewall including a second hole slideably receiving the fixed rod.

4. The positioning device as claimed in claim 3, with the fixed rod having an end fixed to a base of the chair, with the inclinable seat pivotally connected to a backrest of the chair, with movement of the clamping seat along the fixed rod allowing adjustment of inclination angles of the inclinable seat and the backrest, and with the fixed rod including a restraining member for restraining a minimum inclination position of the backrest.

5. The positioning device as claimed in claim 3, with the second side of the first clamping member including a first pivotal portion, with the first side of the second clamping member including a second pivotal portion, and with a pin extending through the first and second pivotal portions of the first and second clamping members to allow relative pivotal movement between the first and second clamping members.

6. The positioning device as claimed in claim 5, with the first through-hole of the first clamping member intermediate the first pivotal portion and the first clamping portion of the first clamping member in a height direction perpendicular to the longitudinal direction and the width direction, and with the second through-hole of the second clamping member intermediate the first pivotal portion and the second clamping portion of the second clamping member in the height direction.

7. The positioning device as claimed in claim 6, with each of the first hole of the first sidewall and the second hole of the second sidewall having a diameter slightly larger than an outer diameter of the fixed rod, and with each of the first hole of the first sidewall and the second hole of the second sidewall having an inner periphery in slight tight coupling with an outer periphery of the fixed rod.

8. The positioning device as claimed in claim 7, with the second side of the coupling seat includes a second compartment in communication with the fourth through-hole, with the first coupling rod including a screw hole in an end thereof, with the positioning device further comprising, in combination:

a bearing received in the second compartment and including a central hole through which the first coupling rod extends;

a second coupling rod received in the compartment and including a threaded portion on an end thereof threadedly engaged with the screw hole, with the second coupling rod further including an enlarged head on another end thereof; and a washer mounted between the bearing and the enlarged head of the second coupling rod, with the enlarged head pressing the bearing via the washer, so that the bearing is in contact with a bottom wall of the second compartment for reducing friction during pivotal movement of the handle.

* * * * *